US005127382A

United States Patent [19]

Imoehl

[11] Patent Number: 5,127,382

[45] Date of Patent: Jul. 7, 1992

[54] ELECTRICAL CONNECTOR BAR FOR A FUEL INJECTOR/FUEL RAIL ASSEMBLY AND METHOD OF MAKING

[75] Inventor: William J. Imoehl, Williamsburg, Va.

[73] Assignee: Siemens Automotive L.P., Auburn Hills, Mich.

[21] Appl. No.: 583,733

[22] Filed: Sep. 17, 1990

[51] Int. Cl.[5] ..... F02M 61/14

[52] U.S. Cl. ..... 123/470; 123/456

[58] Field of Search ..... 123/456, 470, 472, 468, 123/469; 439/77, 516, 171, 180, 80, 70

[56] References Cited

U.S. PATENT DOCUMENTS

| | | | |
|---|---|---|---|
| 3,788,287 | 1/1974 | Falen | 123/472 |
| 4,570,601 | 2/1986 | Ito et al. . | |
| 4,844,036 | 7/1988 | Bassler et al. . | |
| 4,895,124 | 1/1990 | Bartholomew | 123/468 |
| 4,922,880 | 5/1990 | Seibt | 123/470 |
| 4,950,171 | 8/1990 | Muzslay . | |
| 5,016,594 | 5/1991 | Hafner | 123/470 |

*Primary Examiner*—Carl Stuart Miller

*Attorney, Agent, or Firm*—George L. Boller; Russel C. Wells

[57] ABSTRACT

A number of electrically-operated fuel injectors are mounted in a fuel rail assembly, and electrical circuit connections to the injectors are provided by an electrical connector which contains a flexible strip onto a lengthwise edge of which are disposed electrical outlet terminals for making connection of individual conductor paths on the strip to the individual injectors. Electrical inlet terminals are also disposed on the strip to provide for connection to a source of signals for operating the injectors.

24 Claims, 10 Drawing Sheets

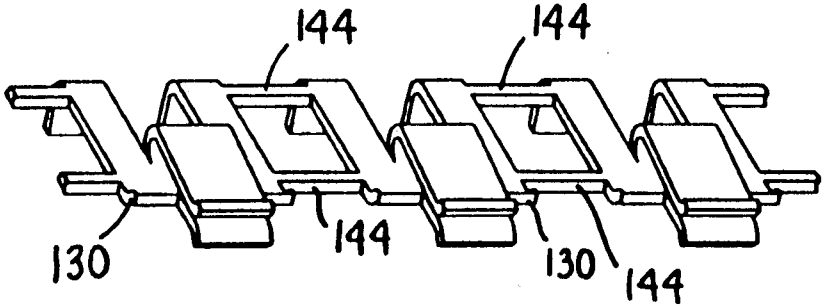
FIGURE 7
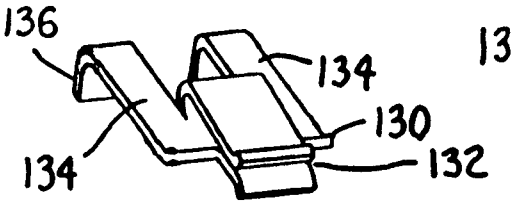
FIGURE 5
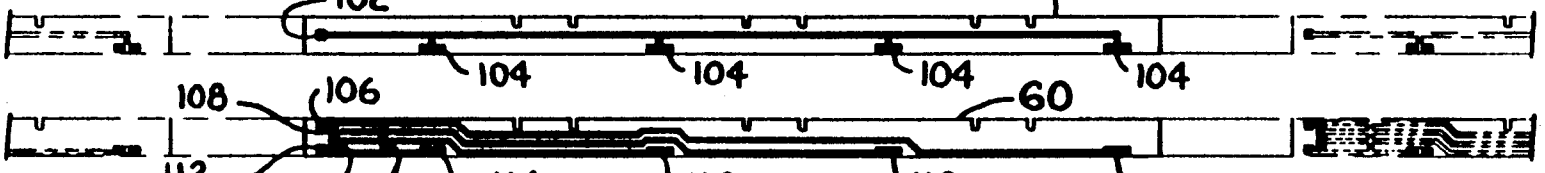
FIGURE 3
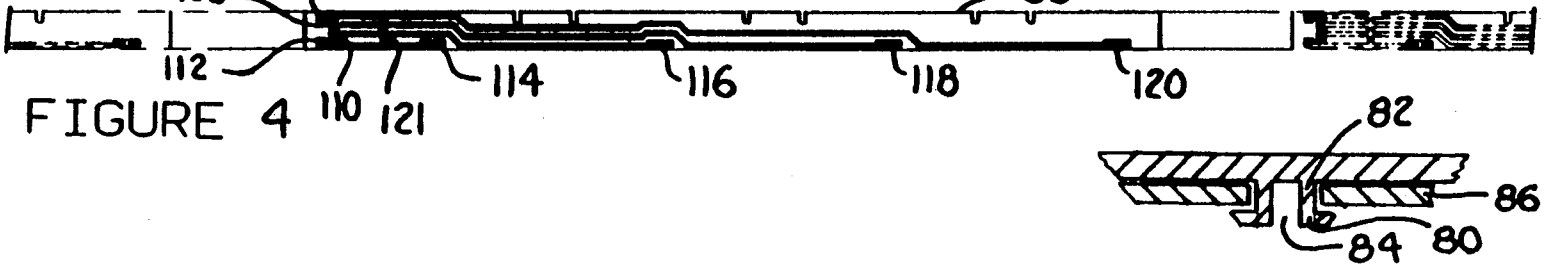
FIGURE 4
FIGURE 6

ELECTRICAL CONNECTOR BAR FOR A FUEL INJECTOR/FUEL RAIL ASSEMBLY AND METHOD OF MAKING

FIELD OF THE INVENTION

This invention relates to fuel rails for internal combustion engines.

BACKGROUND AND SUMMARY OF THE INVENTION

Known U.S. Pat. Nos. relating to the field of the invention are: 4,570,601; 4,844,036; and 4,950,171.

In U.S. Pat. No. 4,570,601 the electrical conductors are directly embedded in the synthetic resin of the fuel delivery pipe during the molding step.

Essential features of the design disclosed in U.S. Pat. No. 4,844,036 include a housing, floating connecter receptacles interconnected by stranded copper wire, and an end connector. Assembly requires many manual operations including: insertion of the metallic terminals into the connector receptacles, soldering of the copper wire to the terminals, insertion of the interconnected receptacles into the housing, heat staking of the copper wires to the housing, ultrasonic welding of the receptacle retainer to the housing, and welding of the wires to the end connector.

In U.S. Pat. No. 4,950,171 a flexible circuit board is held trapped in a bent condition between upper and lower connector bar parts.

The present invention relates to a new and unique fuel rail assembly and method of manufacture with particular emphasis on the arrangement for providing the electrical circuit connection to the fuel injectors. The present invention provides for more cost-efficient, high-volume production of a fuel rail than available with the known art, particularly with reference to U.S. Pat. No. 4,844,036.

These advantages and benefits of the invention, along with further features, will be seen in the ensuing description which should be considered in conjunction with the accompanying drawings. The drawings disclose a presently preferred embodiment of the invention according to the best mode contemplated at the present time for carrying out the invention.

BRIEF DESCRIPTION OF THE DRAWINGS

FIG. 3 is a plan view of one individual component of FIG. 1 shown by itself.

FIG. 4 is a plan view of another individual component of FIG. 1 shown by itself.

FIG. 5 is a perspective view of yet another individual component of FIG. 1 shown by itself.

FIG. 6 is a fragmentary transverse cross-sectional view through a portion of FIG. but with the parts in assembled relationship.

FIG. 7 is a perspective view illustrating a stage in the process of fabricating the component of FIG. 5.

DESCRIPTION OF THE PREFERRED EMBODIMENT

FIGS. 1 through 6 illustrate a first embodiment of electrical connector bar assembly 50 embodying principles of the present invention. Assembly 50 mounts on a fuel rail that contains plural electrically-operated fuel injectors at spaced apart locations along the length of the fuel rail. The fuel rail is not illustrated in FIGS. 1 through 6, but can be understood to comprise a configuration for fuel injectors that are of the bottom-feed or side-feed type with each injector having a spray nozzle at one end and a pair of electrical terminals at the opposite axial end. The electrical terminals of each injector project away from the injector body in a direction that is parallel to the central longitudinal axis of the fuel injector, and in each injector one terminal is located diametrically opposite the other as viewed in the direction of the longitudinal axis of the injector. When connector bar assembly 50 is assembled onto the fuel rail, it fits onto the terminal-containing ends of the fuel injectors to provide electric circuit connection of the fuel injectors to a control circuit (also not shown in the Figs.) for electrically operating the injectors.

Figure 1:
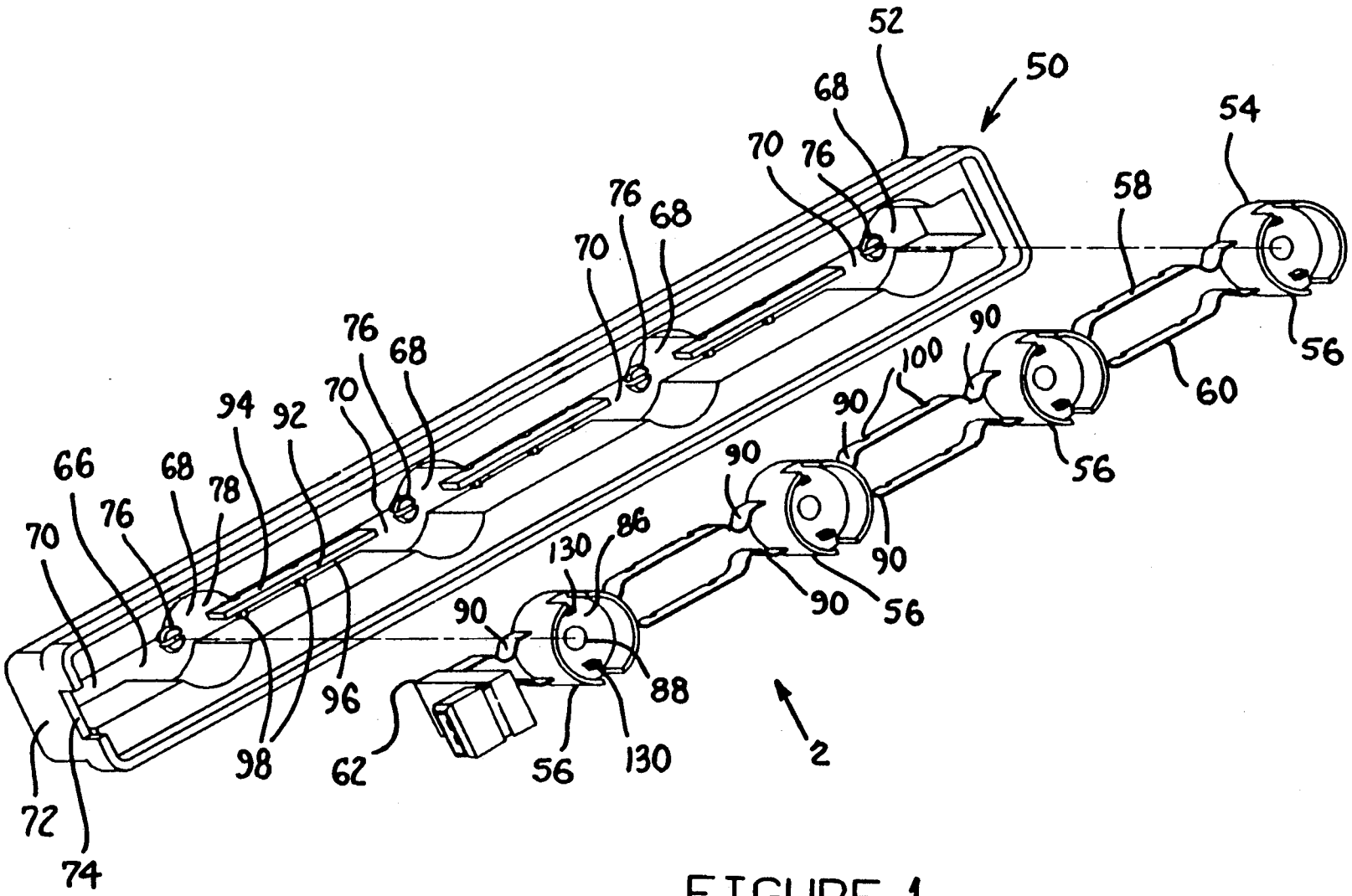
FIG. 1 is a partially exploded perspective view of the electrical connector bar portion of a fuel rail assembly embodying principles of the present invention.
Figure 2:
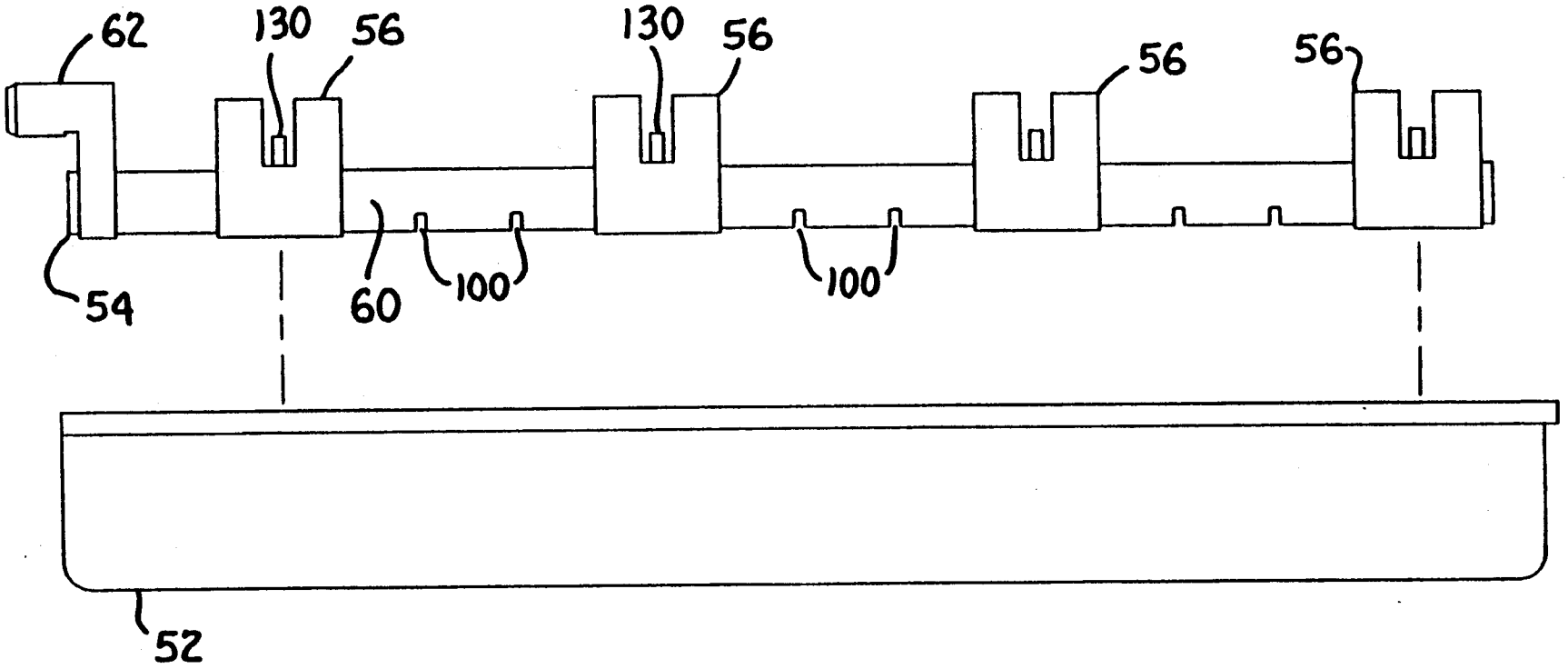
FIG. 2 is a side elevational view in the direction of arrow 2 in FIG. 1.

The configuration of connector bar assembly 50 shown in FIGS. 1-6 is intended to serve four fuel injectors. FIGS. 1 and 2 show that connector bar assembly 50 comprises a rigid cover 52 and an electrical assembly 54. Cover 52 is preferably fabricated from a suitable synthetic material which has a dielectic character. Injection molding is a convenient way to fabricate this part. Electrical assembly 54 comprises four spaced apart sockets 56, also of dielectric material, which are joined together in assembly by means of two transversely spaced apart flexible strips 58 and 60 respectively. A connector plug 62 is disposed on the near ends of strips 58 and 60 as viewed in FIG. 1.

Cover 52 has a cavity 64 shaped to receive electrical assembly 54. Cavity 66 comprises four cylindrical zones 68 into each of which a corresponding socket 56 is inserted, and immediately adjacent zones 68 are joined by slots 70 that run parallel to the length of the cover. There is also a slot 70 that extends from the nearest zone 68 in FIG. 1 to the nearer end wall 72 of cover 52. When assembly 54 is assembled to cover 52, each socket 56 is disposed in a corresponding cylindrical zone 68, the portions of each flexible strip 58 and 60 between immediately adjacent sockets 56 are disposed in a corresponding slot 70, the portions of flexible strips 58 and 60 between the nearest socket 56 and connector plug 62 in FIG. 1 are disposed in the slot 70 between the nearest cylindrical zone 68 and end wall 72, and a portion of plug 62 is also disposed in the latter slot 70. The remainder of plug 62 is shaped to fit to a notch 74 in end wall 72 so that a portion of the plug projects away from end wall 72 on the outside of cover 52.

Assembly 54 is securely retained within cavity 66 by means of catches 76 that are provided on the interior of the cover's top wall 78 essentially concentric with each cylindrical zone 68. As can be seen from consideration of FIGS. 1 and 6, each catch 76 is in the shape of an inverted mushroom depending upside down from the inside of top wall 78. Each mushroom-shaped catch comprises a head 80 and a stem 82 and is divided into two separate halves by means of a diametrical slot 84 extending through both head 80 and stem 82. The head has a generally circular shape but the radially outer peripheral surface is frusto-conically contoured in the manner shown.

The outside diameter of each cylindrical socket 56 is made deliberately somewhat less than the diameter of the corresponding cylindrical zone 68. Each socket has a transverse end wall 86 of circular shape which contains a concentric circular through-hole 88. A diameter of each through-hole 88 is chosen in relation to the shape of the frusto-conical outer peripheral surface of the corresponding mushroom head such that as the two parts 52 and 54 are being assembled together, the edge of through-hole 88 will abut the frusto-conical peripheral surface of the mushroom head with the result that the mushroom head tends to center the corresponding socket with respect to its cylindrical zone 68. Continued advancement of assembly 54 into cavity 66 will cause the two halves of each catch to be flexed toward each other so as to reduce the effective diameter of the head to a size that allows the head to pass completely through the corresponding through-hole 88 with the result that the resiliently flexed halves of each catch then relax to return to the shape illustrated in FIG. 6 where the head of the mushroom is in interference with the margin of top wall 86 surrounding each through-hole 88 thereby preventing the socket from being axially withdrawn from the cylindrical zone 68.

The dimensions of each stem 82 in relation to the corresponding through-hole 88 are such that after assembly of part 54 to part 52 has been completed, each socket can position itself within its own zone 68 over a range of limited movement. There is a slight amount of axial play, a certain amount of radial play, so that it is possible for the axis of each socket to be not only slightly eccentric to its zone's axis but also slightly tilted from parallelism with the axis of the corresponding zone 68. It is in this way that each socket may be said to possess the ability to float to a certain limited extent on cover 52, and this feature is advantageous in facilitating attachment of the connector bar assembly 50 to the rail-mounted fuel injectors because it can accommodate a larger tolerance on the alignments of the injectors on the fuel rail.

In the condition illustrated by FIG. 1, the longitudinal axis of each socket 56 is coaxial with the axis of the corresponding cylindrical zone 68. It can be seen that in this condition each flexible strip 58, 60 contains a number of bends 90. If assembly 54 were to be axially expanded from the condition illustrated in FIG. 1 in an amount sufficient to make both strips straight so that bends 90 would disappear, such a condition would amount to each of the two strips 58, 60 being in a flattened, prefabricated condition. In such prefabricated condition, the spacing distance along the length of each strip between the longitudinal axes of the sockets is greater than that which exists for the condition portrayed in FIG. 1. The presence of bends 90 in the flexible strips 58 and 68 amounts to a slack condition which allows for both axial expansion and contraction without the creation of undesirable internal stresses in assembly 54 in use in response to changing temperature conditions which may range from extreme cold to extreme heat. The slack condition also enables the sockets to float within their cylindrical zones 68 in the manner described above without the generation of undesired internal stresses.

As an aid to forming the bends 90, the top wall of cover 52 is provided with a series of partitions 92 within slots 70. Each partition 92 defines two channels 94 and 96 which are on opposite sides of the partition. Flexible strip 58 occupies channel 94 and flexible strip 60, channel 96. It can also be seen that at the base of each channel as viewed in FIG. 1, there are two tabs 98 that extend transversely across each channel. When the two parts 52 and 54 are assembled together, these tabs 98 fit into corresponding notches 100 that are suitably located in the flexible strips 58 and 60. In this way, cover 52 and electrical assembly 54 are constructed and arranged to have locating means for locating each relative to the other to insure the formation of bends 90, as shown.

FIG. 3 illustrates a plan view of flexible strip 58. Strip 58 is fabricated through the use of conventional flexible circuit manufacturing technology to comprise a dielectric body containing electrical conductor pads from connector plug 62 to the four sockets 56. Similarly, FIG. 4 shows a plan view of flexible strip 60.

Strip 58 is fabricated as a segment of a much longer strip which contains a succession of identical strips 58. Similarly, strip 60 is fabricated as a segment of a much longer strip containing like repeats of itself.

From an electrical standpoint, strip 58 may be considered a common, or ground, strip since it provides for electrical connection of the same terminal of each fuel injector to a common terminal of connector plug 62. Strip 60 may be considered as a power, or feed, strip which feeds the other terminal of each injector from a corresponding terminal of connector plug 62. Strip 58 comprises a terminus 102 at connector plug 62 and four termini 104 at spaced apart locations along one lengthwise margin of the strip. The four termini 104 are for the respective fuel injectors but are electrically connected in common with terminus 102.

Figure 8:
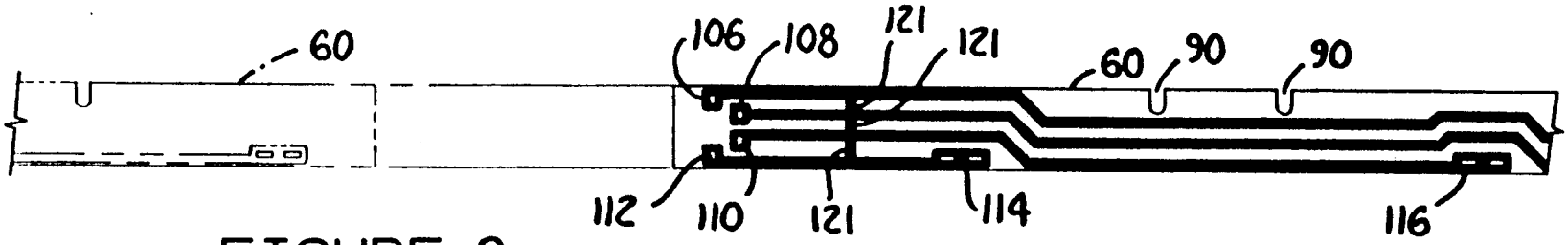
FIG. 8 is a plan view illustrating greater detail of FIG. 4.

Strip 60 has four termini 106, 108, 110, and 112 at connector plug 62, and it has four more termini 114, 116, 118 and 120 which are spaced apart along the length of the strip, one per injector. In the illustration of FIG. 4, all eight termini are connected in common by virtue of a bridging conductor path 121 which extends transversely across the strip just to the right of termini 106–112 as viewed in FIG. 4. FIG. 8 shows greater detail.

The configuration of FIG. 8 is such that when an energizing signal is delivered to any one or all of the termini 106–112, the same signal is presented at all other of the strip's termini. This configuration is suitable for a fuel rail in which it is intended that all injectors operate simultaneously.

Figure 9:
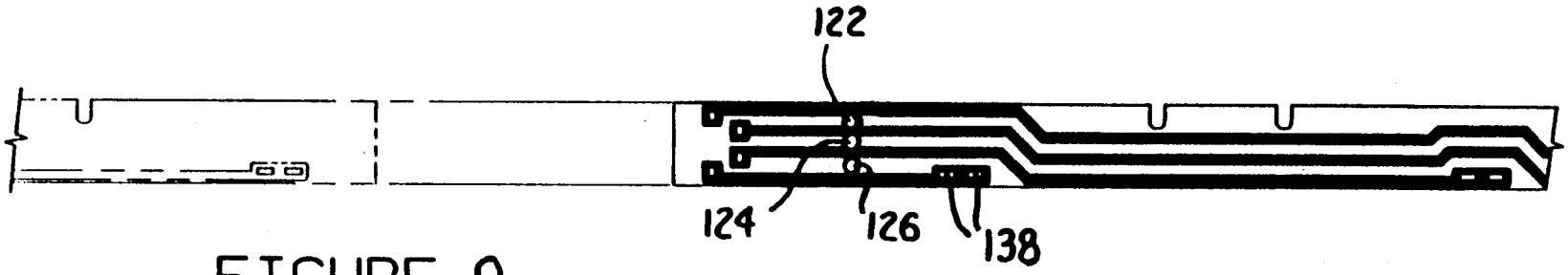
FIG. 9 is a view similar to FIG. 8 illustrating a modified form.

If it is desired to operate any one or more of the injectors independently, then a modification is made to the prefabricated strip by disrupting the bridging conductor path 121. FIG. 9 illustrates one example of interrupting the bridging conductor path 121 by removing it entirely. Such removal is accomplished by creating three throughholes 122, 124 and 126 in the strip in the manner shown in FIG. 9. This disruption of the bridging conductor path causes the conductor path between each terminus 106, 108, 110, 112 and the respective terminus 120, 118, 116, 114 to be independent. In other words, the conductor path between terminus 106 and terminus 120 has no electrical circuit continuity to the conductor path between terminus 108 and terminus 118, the latter conductor path has no electrical continuity to the conductor path between terminus 110 and terminus 116, and the latter conductor path has no electrical continuity to the conductor path between terminus 112 and terminus 114. This configuration represented by FIG. 9 provides for the independent operation of each fuel injector.

Figure 10:
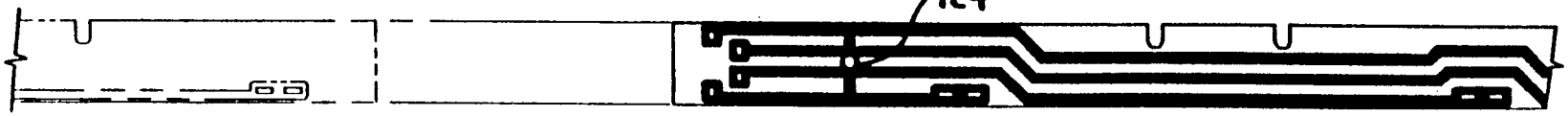
FIG. 10 is another view similar to FIG. 8 illustrating a further modified form.
Figure 11:
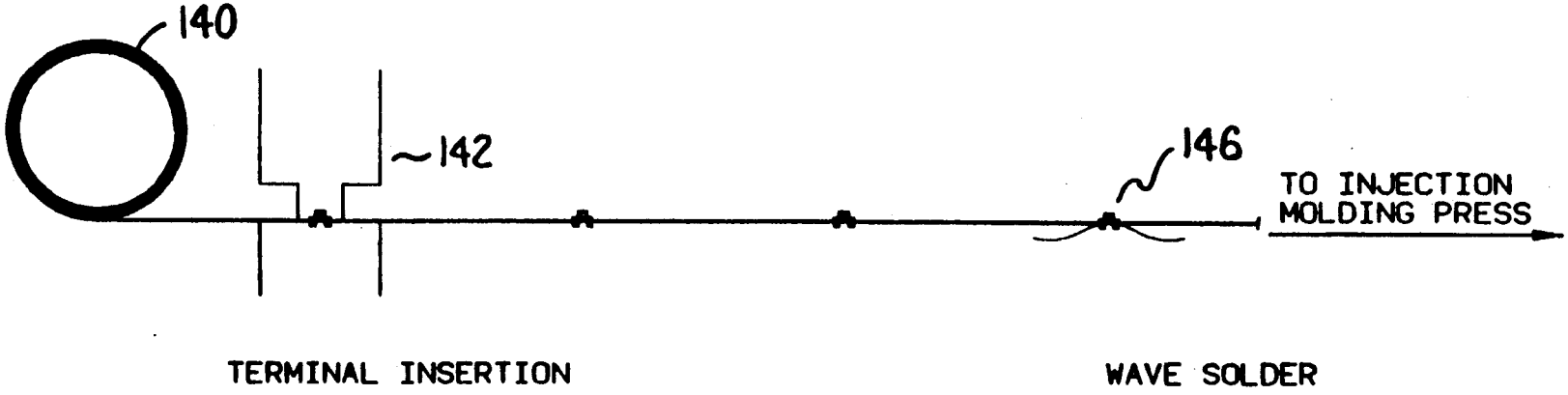
FIG. 11 is a side elevational view illustrating certain method principles of the invention.

The configuration of FIG. 10 illustrates only a partial disruption of the bridging conductor path 121 by the inclusion of only hole 124. In this configuration, termini 106, 108 and termini 120, 118 have electrical continuity, but are electrically isolated from termini 110, 112 and termini 118, 116, the latter four termini having electrical continuity amongst themselves. This configuration of FIG. 10 is useful for the simultaneous operation of one pair of injectors independent of the simultaneous operation of the other pair of injectors.

Regardless of which configuration is utilized for flexible strip 60, it is necessary that this flexible strip, and also flexible strip 58, both have electrical outlet terminals for making separable physical connection with the fuel injector electrical terminals and also electrical inlet terminals that mate with corresponding terminals of a connector plug (not shown) that mates with connector plug 62. FIG. 5 illustrates an exemplary form of an electrical outlet terminal 130.

Figure 13:
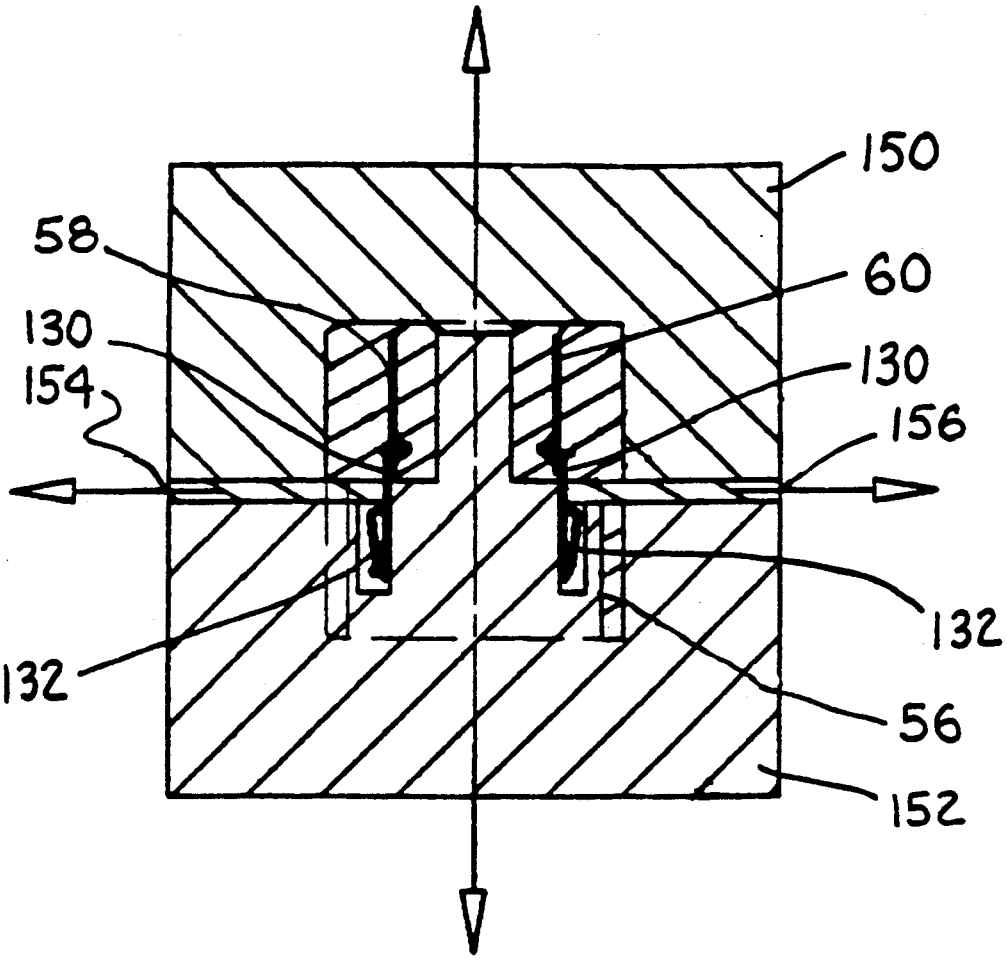
FIG. 13 is a transverse cross-sectional view on an enlarged scale taken generally in the direction of arrows 13—13 in FIG. 12.

Terminal 130 comprises a centrally located pincers 132 that is adapted to separably fit onto an electrical terminal of a fuel injector. On laterally opposite sides of the pincers the terminal has a pair of fingers 134 that project in the opposite direction away from the pincers and terminate in tabs 136 that are generally at a right angle to the length of the fingers. Each terminus 104, 114, 116, 118, 120 is shaped to have a pair of holes 138 through which tabs 136 can be passed as can be seen in FIG. 13. A a suitable manufacturing technique causes each outlet terminal 130 to be mechanically joined to the strip and placed in electrical continuity with the corresponding conductor path terminus on the strip. A typical outlet terminal assembled onto a strip will result in a configuration wherein a distal portion of the terminal overlaps the strip and a proximal portion of the terminal extends across and beyond the lengthwise extending edge of the strip. In the embodiment shown in FIG. 5, the tabs 136 and an immediately adjoining portion of each finger 134 would constitute the aforementioned proximal portion of the outlet terminal while the remainder of the terminal, including the pincers 132 would constitute the distal portion.

In similar fashion, electrical inlet terminals of suitable configuration (not specifically illustrated) are assembled onto the strip so as to obtain electrical continuity with the corresponding termini at the end of the strip. In the configuration depicted by FIG. 2, these electrical inlet terminals would comprise a proximal portion overlapping the strip and a distal portion extending from said proximal portion across and beyond the edge of the strip, and particularly with the distal portion comprising a less distal portion extending transversely of the strip from a lengthwise edge of the strip and a more distal portion that extends transversely of the less distal portion. In the specific embodiment of the drawings, the less distal portion is at right angle to the length of the strip while the more distal portion is at right angle to the less distal portion. It can also be appreciated that the connector plug 62 includes a dielectric shell 140 that provides a lateral surround for the inlet terminals.

Figure 12:
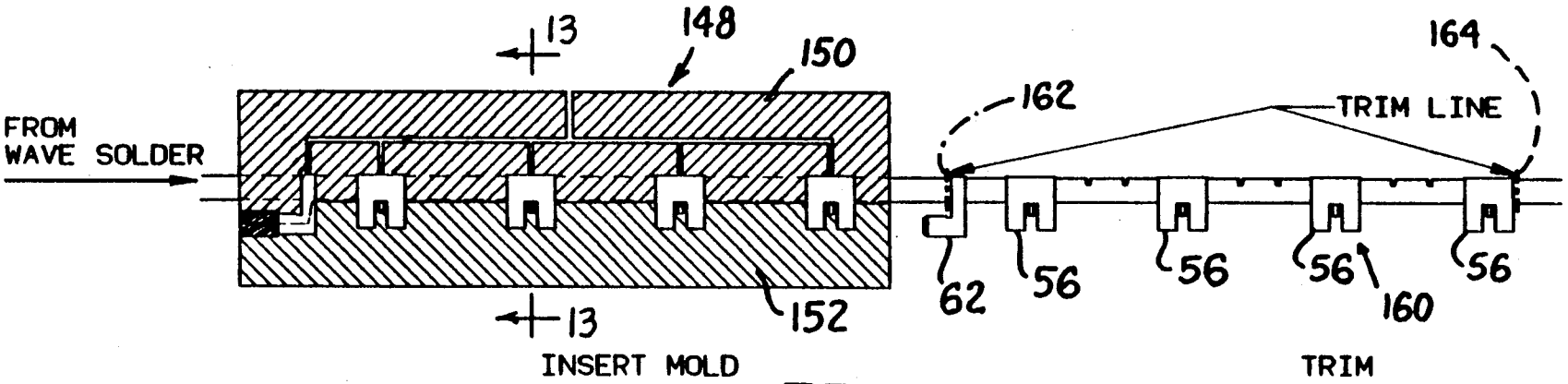
FIG. 12 is a side elevational view partly in section illustrating additional method principles.

FIGS. 12–13 illustrate apparatus and methodology for fabricating the connector bar assembly 50. A coil of flexible strip containing a succession of repeats of the particular individual strip involved is uncoiled and passed through a terminal insertion station 142. At the terminal insertion station 142 an electrical outlet terminal is automatically assembled onto the strip in the manner described above. Individual electrical outlet terminals are obtained from a metal strip in which the terminals are individually formed from the strip and held together by connector bars 144 as can be seen in FIG. 7. At station 142 each individual outlet terminal is severed from the strip with the connector bars 144 being discarded as scrap.

After the terminal insertion station, a wave solder operation may be conducted at a wave solder station 146 to solder each terminal to the corresponding conductor path terminus on the strip. From there, the strip is conducted to an insert molding station 148. The insert molding station comprises an injection mold having several moving parts. The illustrated mold has an upper mold part 150, a lower mold part 152 and two side mold parts (FIG. 13) 154, 156. FIG. 13 represents the closed condition of the mold wherein the several mold parts define an internal cavity. This cavity is served by runners through which the fluid plastic is injected to fill the cavity. As can be seen from consideration of FIG. 12, the molding operation forms sockets 56 and the shell 140 of connector plug 62. The molding of the sockets serves to capture the outlet terminals 130 in the top walls of the sockets in the manner represented by FIG. 13. The result is that the sockets are molded around the flexible strip and the portion of each outlet terminal that overlaps the strip. The distal portion of each terminal projects free. It can be seen in FIG. 13 that the mold parts 154, 156, which come in from opposite sides to abut sides of the terminals, serve to prevent the fluid plastic material from entering spaces in the cavity that are reserved for the pincers of each terminal. In this way, the pincers of each terminal is not covered by the socket but rather remains free so that the pincers can flex onto and off of the corresponding injector terminal when the connector bar assembly is assembled onto and off of the injector containing fuel rail.

After the insert molding step has been completed, the mold is opened and the strip is next advanced to a trim station 160 where the assembly is severed at the trim lines 162, 164 as indicated in FIG. 12. Since the inlet terminals will have a different shape from the outlet terminals they are assembled onto the strip at their own terminal insertion station which is not shown in the drawing figures but is understood to be present on the basis of this written description. For example such a station could be located between stations 142 and 146 so that the inlet terminal could also be wave soldered to the flexible strip at station 146.

Figure 14:
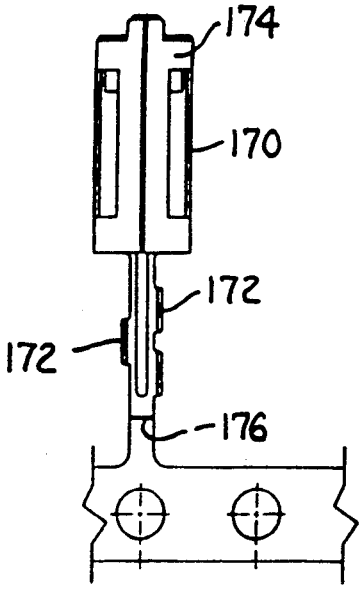
FIG. 14 is a top plan view illustrating a modified form for the component of FIG. 7.
Figure 15:
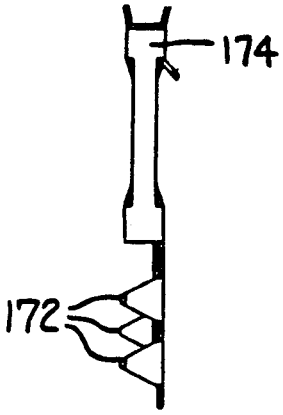
FIG. 15 is a right side elevational view of a portion of FIG. 14.
Figure 16:
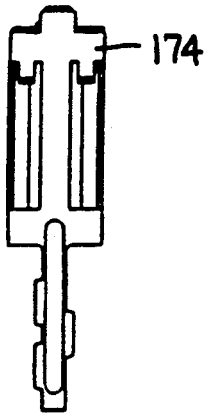
FIG. 16 is a bottom plan view of a portion of FIG. 14.

FIGS. 14–16 present an alternate form of outlet terminal 170. Such terminals are fabricated from a metal strip and are adapted for automated assembly to the flexible strips 58, 60 in analogous fashion to that described for outlet terminal 130. Terminal 170 differs from terminal 130 in that the former is designed to be crimped onto the strip and make a satisfactory mechanical and electrical attachment without the use of a wave soldering operation. The proximal portion of each terminal 170 comprises multiple piercing barbs 172 which pierce the strip when the proximal portion of the terminal is forced against the strip. The pierce is through a suitably shaped terminus of a conductor path of the strip and creates electrical continuity between the conductor path and the terminal. After the pierce, the barbs are crimped to prevent their withdrawal through the holes which they have pierced. The distal portion of the terminal is in the form of an elongate, rectangular-shaped receptacle 174. The numeral 176 represents a line of severing at which the automated assembly equipment at the terminal insertion station severs each terminal 170 from the strip containing the terminals.

Figure 17:
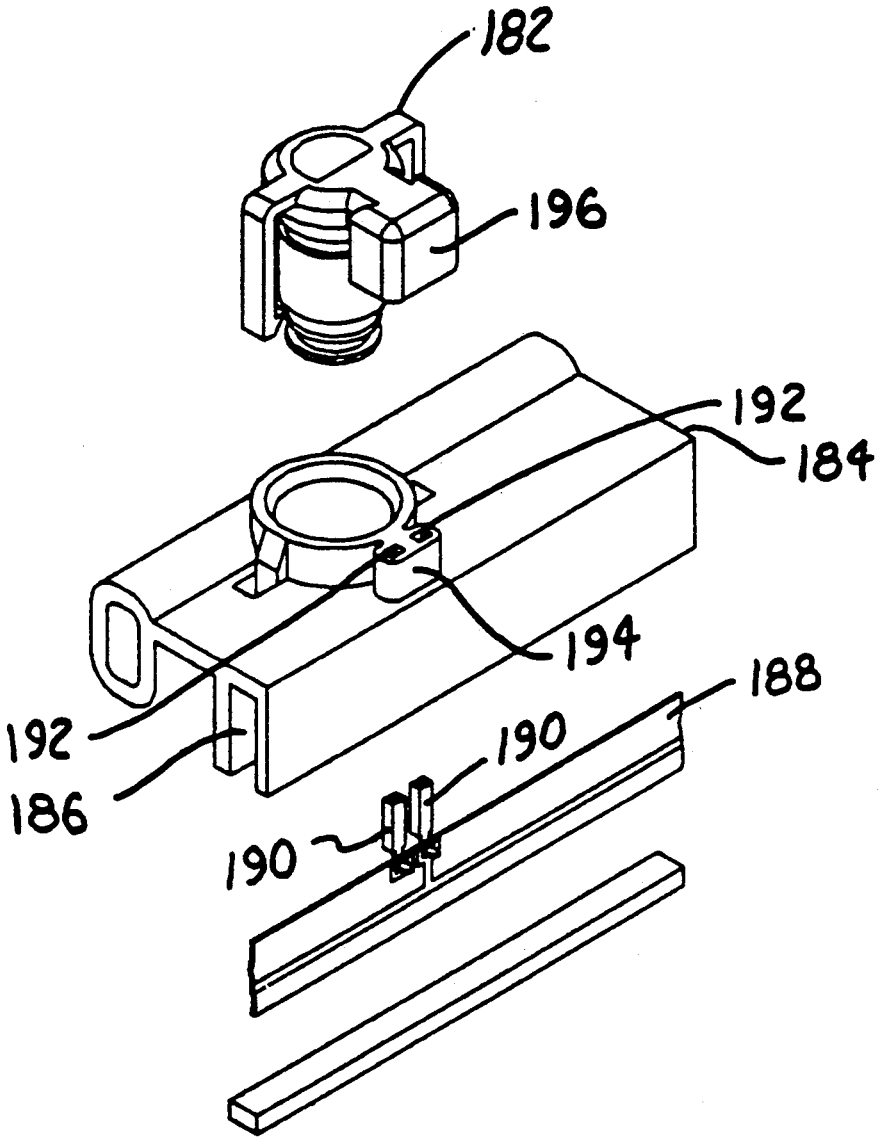
FIG. 17 is an exploded fragmentary perspective view of another embodiment of fuel rail assembly embodying the inventive principles.

FIG. 17 shows a fuel rail 180 and a fuel injector 182 like that disclosed in commonly assigned co-pending application of L. G. Grace, Ser. No. 07/, filed 29 June 1990. This embodiment integrates the connector bar 184 to the fuel rail. The connector bar comprises a channel 186 formed integrally with the fuel rail and within which a single flexible strip 188 is disposed. Strip 188 amounts to a combination of the strips 58, 60 in that all conductor paths for connecting the connector plug 2 to the fuel injector terminals are on strip 188. For each injector there are two side-by-side terminals 190 assembled onto the lengthwise side edge of the strip that is toward the base of channel 186. These terminals are fitted to holes 192 in the channel so that in the completed assembly, the connector bar structure presents a connector plug formation 194 to a mating connector plug formation 196 on the injector.

Figure 18:
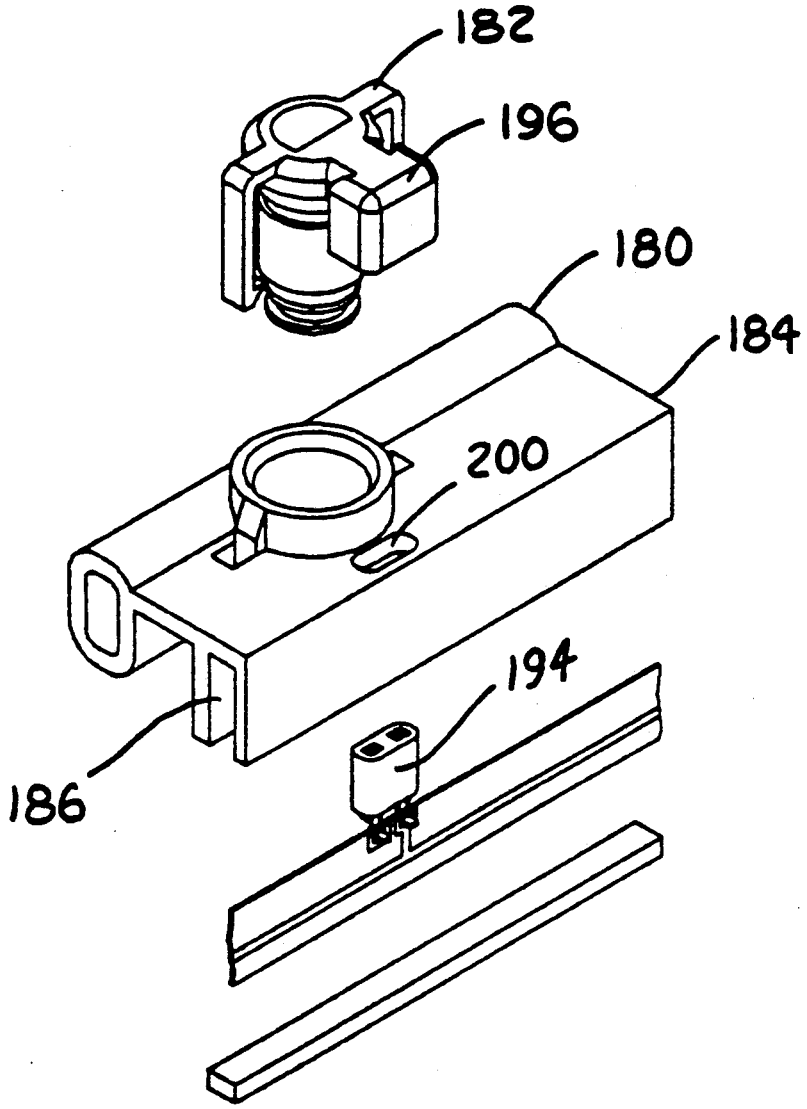
FIG. 18 is an exploded fragmentary perspective view of still another embodiment.

FIG. 1B is quite similar to FIG. 17 and so corresponding components are designated by the same numerals. FIG. 18 differs in that the connector plug formation 194 is on strip instead of the channel 186, and it fits into a hole 200 in the channel base in the finished assembly. By making the plug formation of dielectric material, the material of the fuel rail 180 and its integral channel 186 can be other than a dielectric, i.e. metal.

Figure 19:
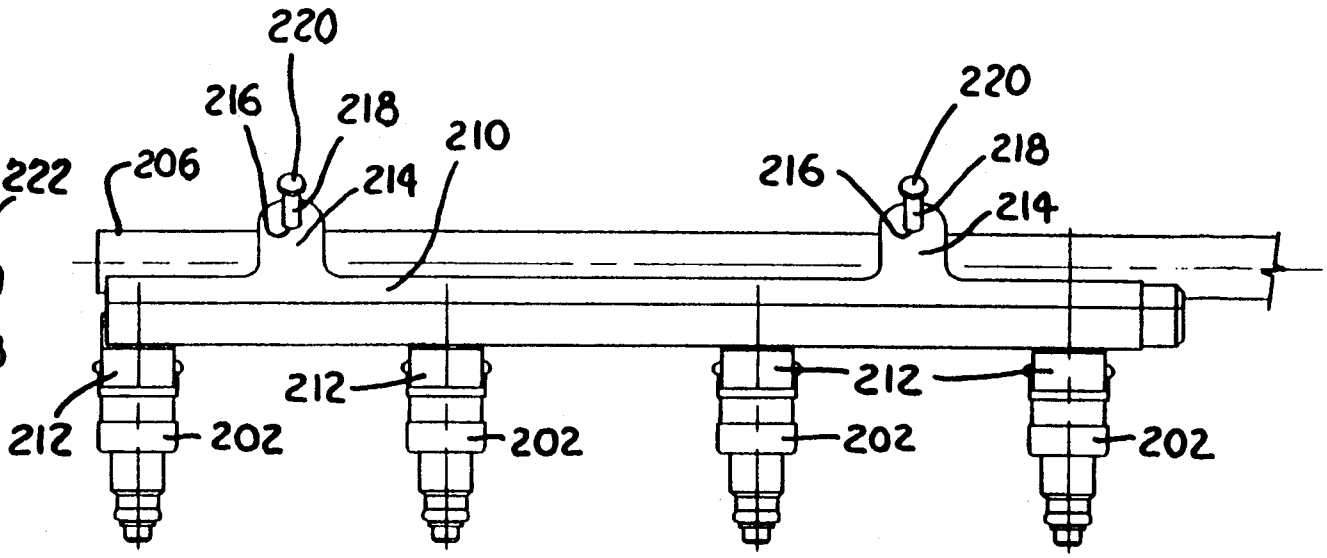
FIG. 19 is a front elevational view of yet another embodiment.
Figure 20:
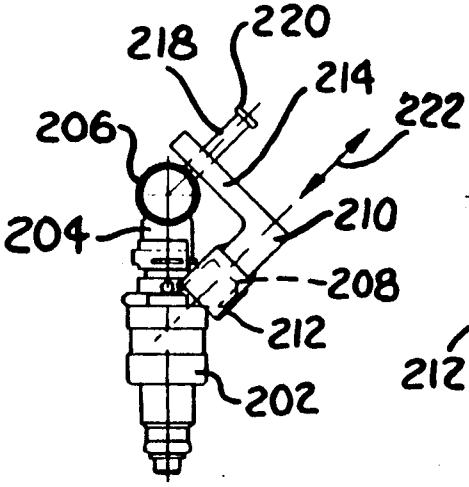
FIG. 20 is a left side elevational view of FIG. 19.

The embodiment of FIGS. 19 and 20 is for top-feed injectors. The tops of the injectors 202 are fitted to suitable cups 204 of the fuel rail 206. Each injector has its electrical terminals in a plug formation 208 which is at the side of the injector and inclined at an acute angle to the injector's longitudinal axis. The connector bar assembly 210 has a length which spans all four injectors and contains plug formations 212 that mate with respective ones of the injectors, plug formations 208. The connector bar also has two tongues 214 which are spaced apart along the length of the connector bar. A distal end portion of each tongue contains a circular through-hole 216. The fuel rail contains two cylindrical pins 218 spaced apart along the length of the fuel rail and with their axes parallel. The tongues 214 fit onto these pins 218 with the pins passing through holes 216, and after such association, the distal end of each pin is provided with a head 220 that serves to prevent separation of the connector bar from the fuel rail. The arrangement however is such that the connector bar can be slid on the pins in the manner portrayed by the double-headed arrow 222 in FIG. 20 to connect to and disconnect from the injectors. The use of this configuration requires that the injectors be properly circumferentially registered in their respective sockets so that the injectors' plug formations are properly circumferentially oriented, and this can be accomplished with suitable design of the injector retention clips used to retain the injectors to the rail.

Thus the invention offers the opportunity for significant improvements in the mass-production fabrication of fuel rails for internal combustion engines. While a preferred embodiment has been disclosed, it should be appreciated that the inventive principles may be practiced in other specific embodiments.

What is claimed is:

1. A fuel rail assembly for an automotive vehicle internal combustion engine comprising a fuel rail containing plural electrically operated fuel injectors at spaced-apart locations along the fuel rail wherein the fuel rail serves to supply pressurized fuel to the fuel injectors, each fuel injector having electric terminal means on the exterior thereof via which electric terminal means the injector is electrically operated to deliver fuel to an engine, and electrical connector structure providing electrical circuit connection of said electric terminal means of said injectors to a control circuit for electrically operating said injectors characterized in that said electrical connector structure comprises a flexible strip arranged such that its length runs in the same direction as that of said fuel rail, said flexible strip contains electrical conductor paths, electrical outlet terminals are assembled to said flexible strip for making electrical circuit connection of said electrical conductor paths to said electric terminal means of said injectors, each of said electrical outlet terminals has a proximal portion making physical contact with a particular one of said electrical conductor paths and a distal portion extending from its proximal portion into separable physical contact with said electric terminal means of said injectors, and electrical inlet terminals are assembled to said flexible strip for making electrical circuit connection to said electrical conductor paths to enable said electrical connector structure to be electrically connected to a control circuit for electrically operating said injectors, in the free condition of said flexible strip apart from said fuel rail then spacing distance along the length of said fuel rail between the longitudinal axes of immediately adjacent fuel injectors is greater than the spacing distance along the length of said flexible strip between the corresponding electrical outlet terminals for the injectors such that said strip is caused to form at least one bend between each pair of immediately adjacent injectors when said strip is in assembly with said fuel rail.

2. A method of making a fuel rail assembly for an automotive vehicle internal combustion engine comprising a a fuel rail containing plural electrically operated fuel injectors at spaced-apart locations along said fuel rail wherein said fuel rail serves to supply pressurized fuel to said fuel injectors, each fuel injector having electric terminal means on the exterior thereof via which electric terminal means the injector is electrically operated to deliver fuel to an engine, and electrical connector structure providing electrical circuit connection of said electric terminal means of said injectors to a control circuit for electrically operating said injectors, said method characterized by adapting a pre-fabricated strip containing electrical conductor paths for a desired mode of operating said injectors by said control circuit, said pre-fabricated strip comprising a group of electrical conductor paths wherein each electrical conductor path of the group is individual to a particular injector, but the pre-fabricated strip includes a bridging conductor path that electrically bridges all electrical conductor paths of said group, said method comprising leaving said bridging conductor path in bridging relation to all conductor paths of said group when simultaneous operation of said injectors is desired and disrupting the bridging of said conductor paths of said group by said bridging conductor path so as to enable at least one of said injectors to be operated independently of the operation of at least one other of said injectors.

3. A method as set forth in claim 2 characterized further in that the disrupting of the bridging relation is conducted by creating a through-hole in said strip to remove some of said bridging conductor path.

4. A method of making a fuel rail assembly for an automotive vehicle internal combustion engine comprising a a fuel rail containing plural electrically operated fuel injectors at spaced-apart locations along said fuel rail wherein said fuel rail serves to supply pressurized fuel to said fuel injectors, each fuel injector having electric terminal means on the exterior thereof via which electrical terminal means the injector is electrically operated to deliver fuel to an engine, and electrical connector structure providing electrical circuit connection of said electric terminal means of said injectors to a control circuit for electrically operating said injectors, said method characterized by fabricating a flexible strip containing identical repeating segments, each repeating strip segment comprising electrical conductor paths for accomplishing a desired mode of operating said injectors by said control circuit, assembling said electrical outlet terminals to one of said strip segments, assembling electrical input terminals to said one of said strip segments, severing said one of said strip segments from the strip, and assembling said one of said strip segments to the fuel rail such that said electrical outlet terminals are placed in separable physical contact with said electrical terminal means of said injectors.

5. Method as set forth in claim 4 further characterized in that sockets containing said electrical outlet terminals for said injectors and a dielectric shell for said electrical inlet terminals are assembled to said strip segment prior to assembly thereof to said fuel rail.

6. Method as set forth in claim 5 further characterized in that said sockets and said shell are insert-molded onto said one strip segment by injection molding before said one strip segment is severed from said flexible strip.

7. A fuel rail assembly for an automotive vehicle internal, combustion engine comprising a fuel rail containing plural electrically operated fuel injectors at spaced-apart locations along the fuel rail wherein the fuel rail serves to supply pressurized fuel to the fuel injectors, each fuel injector having electric terminal means on the exterior thereof via which electric terminal means the injector is electrically operated to deliver fuel to an engine, and electrical connector structure providing electrical circuit connection of said electric terminal means of said injectors to a control circuit for electrically operating said injectors characterized in that said electrical connector structure comprises a flexible strip having a length, width, and thickness including lengthwise and widthwise extending side edges and arranged such that its length runs in the same direction as that of said fuel rail, said flexible strip contains electrical conductor paths, electrical outlet terminals are assembled to said flexible strip for making electrical circuit connection of said electrical conductor paths to said electric terminal means of said injectors, each of said electrical outlet terminals has a proximal portion overlapping said flexible strip and making physical contact with a particular one of said electrical conductor paths and a distal portion extending from its proximal portion across and beyond a lengthwise extending side edge of said flexible strip, said distal portions of said electrical outlet terminals are in separable physical contact with said electric terminal means of said injectors, and electrical inlet terminals are assembled to said flexible strip for making electrical circuit connection to said electrical conductor paths to enable said electrical connector structure to be electrically connected to a control circuit for electrically operating said injectors.

8. A fuel rail assembly as set forth in claim 7 characterized further in that each of said electrical inlet terminals has a proximal portion overlapping said flexible strip and making physical contact with a particular one of said conductor paths and a distal portion extending from its proximal portion across and beyond one of said side edges of said flexible strip.

9. A fuel rail assembly as set forth in claim 8 characterized further in that said one of said side edges of said flexible strip across and beyond which said distal portions of said electrical inlet terminals extend from their respective proximal portions is a widthwise side edge of said flexible strip.

10. A fuel rail assembly as set forth in claim 8 characterized further by the inclusion of a dielectric shell disposed on said flexible strip to provide a lateral surround for said distal portions of said electrical inlet terminals.

11. A fuel rail assembly as set forth in claim 8 characterized further in that said one of said side edges of said flexible strip across and beyond which said distal portions of said electrical inlet terminals extend from their respective proximal portions is a lengthwise side edge of said flexible strip and each of said distal portions of said electrical inlet terminals includes a less distal portion extending transversely of the length of said flexible strip and a more distal portion extending transversely of its less distal portion.

12. A fuel rail assembly as set forth in claim 11 characterized further in that said less distal portion of each of said electrical input terminals extends generally at a right angle to the length of said flexible strip and each more distal portion extends generally at a right angle to its less distal portion.

13. A fuel rail assembly as set forth in claim 7 characterized further in that said electrical conductor paths of said flexible strip comprise a group of independent electrical conductor paths wherein each electrical conductor path of the group is individual to a particular fuel injector.

14. A fuel rail assembly as set forth in claim 13 characterized further in that said electrical conductor paths of said flexible strip comprise an electrical conductor path that is common to all said fuel injectors.

15. A fuel rail assembly as set forth in claim 13 characterized further by a second flexible strip having a length, width, and thickness including lengthwise and widthwise extending side edges and arranged such that its length runs in the same direction as that of said fuel rail, said second flexible strip contains electrical conductor paths, electrical outlet terminals are assembled to said second flexible strip for making electrical circuit connection of said electrical conductor paths thereof to said electric terminal means of said injectors, each of said electrical outlet terminals assembled to said second flexible strip has a proximal portion overlapping said second flexible strip and making physical contact with a particular one of said electrical conductor paths thereof and a distal portion extending from its proximal portion across and beyond a lengthwise extending side edge of said second flexible strip, said distal portions of said electrical terminals assembled to said second flexible strip are in separable physical contact with said electric terminal means of said injectors, and at least one electrical inlet terminal is assembled to said second flexible strip for making electrical circuit connection to said electrical conductor paths thereof to enable said electrical connector structure to be electrically connected to a control circuit for electrically operating said injectors.

16. A fuel rail assembly as set forth in claim 15 characterized further in that said electrical conductor paths of said second flexible strip comprise an electrical conductor path that is common to all said fuel injectors and said at least one inlet terminal assembled to said second flexible strip is in physical contact with said electrical conductor path of said second flexible strip that is common to all said fuel injectors.

17. A fuel rail assembly as set forth in claim 15 characterized further by the inclusion of a dielectric shell disposed on both of said flexible strips and providing a lateral surround of said distal portions of said electrical inlet terminals assembled to both of said flexible strips.

18. A fuel rail assembly as set forth in claim 15 characterized further in that said electric terminal means of each injector comprises two electric terminals disposed in diametrically opposite halves of the injector as viewed along a longitudinal axis of the injector, one electric terminal of each injector is in separable physical contact with a corresponding electrical outlet terminal assembled to one of said flexible strips, and the other electric terminal of each injector is in separable physical contact with a corresponding electrical outlet terminal on the other of said flexible strips.

19. A fuel rail assembly as set forth in claim 18 characterized further by the inclusion of dielectric sockets, there is one such socket for each injector, and each socket contains a corresponding electrical outlet terminal that is assembled to said one flexible strip and a corresponding electrical outlet terminal that is assembled to said other flexible strip.

20. A fuel rail assembly as set forth in claim 19 characterized further by the inclusion of a cover member that fits over said sockets, each of said sockets comprises a transverse wall that contains the corresponding electrical outlet terminals separably physically contacting a corresponding fuel injector, each of said transverse walls contains a hole that is generally coaxial with the axis of the corresponding fuel injector, said cover member comprises a wall overlying said holes and containing spaced apart catches, and each catch fits to the corresponding hole to provide for attachment of each socket to said cover member in such a manner that each socket has a slight amount of float on the cover member to facilitate the fitting of said sockets to said fuel injectors when a sub-assembly comprising said cover member and said sockets is assembled onto said injectors.

21. A fuel rail assembly as set forth in claim 20 characterized further in that said cover member and said flexible strips contain locating means for relatively locating said flexible strips with respect to said cover member.

22. A fuel rail assembly as set forth in claim 21 characterized further in that in the free condition of said flexible strips apart from said cover member, the spacing distance along the length of each of said flexible strips between immediately adjacent electrical outlet terminals thereon is greater than the spacing distance along the length of the fuel rail between the longitudinal axes of immediately adjacent fuel injectors, and said locating means acts such that said strips are caused to form bends when said strips and sockets are in assembly with said cover member.

23. A fuel rail assembly as set forth in claim 7 characterized further in that in the free condition of said flexible strip apart from said fuel rail the spacing distance along the length of said fuel rail between the longitudinal axes of immediately adjacent fuel injectors is greater than the spacing distance along the length of said flexible strip between the corresponding electrical outlet terminals for the injectors such that said strip is caused to form at least one bend between each pair of immediately adjacent injectors when said strip is in assembly with said fuel rail.

24. A fuel rail assembly as set forth in claim 1 characterized further in that said electrical connector structure comprises a rigid cover member containing said flexible strip and said electrical outlet terminals, and said rigid cover member is slidably guided on said fuel rail by a guide means for bodily displacement transversely of said fuel rail to separate said electrical outlet terminals from said electric terminal means.

* * * * *